United States Patent [19]

Werner

[11] 4,282,275

[45] Aug. 4, 1981

[54] COATING METHOD APPARATUS FOR CAPSULAR COATINGS

[75] Inventor: Charles E. Werner, Chillicothe, Ohio

[73] Assignee: The Mead Corporation, Dayton, Ohio

[21] Appl. No.: 111,741

[22] Filed: Jan. 14, 1980

[51] Int. Cl.[3] ..... B05D 1/28

[52] U.S. Cl. ..... 427/428; 118/246; 118/249; 118/262; 427/150; 427/152

[58] Field of Search ..... 427/428, 150, 152; 118/246, 249, 244, 262

[56] References Cited

U.S. PATENT DOCUMENTS

| | | | |
|---|---|---|---|
| 1,914,488 | 6/1933 | Custers | 118/262 X |
| 2,185,859 | 1/1940 | Massey | 118/262 X |
| 2,293,691 | 8/1942 | Harrigan | 118/262 X |
| 2,710,590 | 6/1955 | Gerard | 118/246 X |
| 3,186,361 | 6/1965 | Smith et al. . | |
| 3,384,536 | 5/1968 | Sandberg et al. | 117/36.2 |
| 3,472,674 | 10/1969 | Kite | 117/36.1 |
| 3,539,384 | 11/1970 | Kolesinskas | 118/262 X |
| 3,627,557 | 12/1971 | Sato et al. | 118/246 X |
| 3,630,835 | 12/1971 | Busch | 427/391 X |
| 3,632,378 | 1/1972 | Busch . | |
| 3,767,451 | 10/1973 | Busch | 427/150 |
| 3,897,578 | 7/1975 | Kanda et al. | 427/358 |
| 3,914,511 | 10/1975 | Vassiliades | 427/150 X |
| 3,983,840 | 10/1976 | Francis | 118/246 X |
| 4,038,445 | 7/1977 | Robertson | 427/150 |
| 4,085,237 | 4/1978 | Kawakami et al. | 427/150 |
| 4,198,446 | 4/1980 | Goetz | 427/428 |

*Primary Examiner*—Shrive P. Beck
*Attorney, Agent, or Firm*—Stephen H. Cagle

[57] ABSTRACT

A metered film of a fluid coating composition (10) having solids suspended therein, such as a fluid composition containing rupturable microcapsules, is formed on a doctored gravure supply roll (12) and applied to a soft rubber applicator roll (20). The supply roll (12) transfers the metered coating composition (10) to an endless web (25) which is wrapped and tensioned therearound in substantially uncompressed contact, to transfer the metered coating composition uniformly and evenly to the web (25) without shearing the composition (10) when on the web (25) or mechanically pressing the solids therein into the web (25).

5 Claims, 1 Drawing Figure

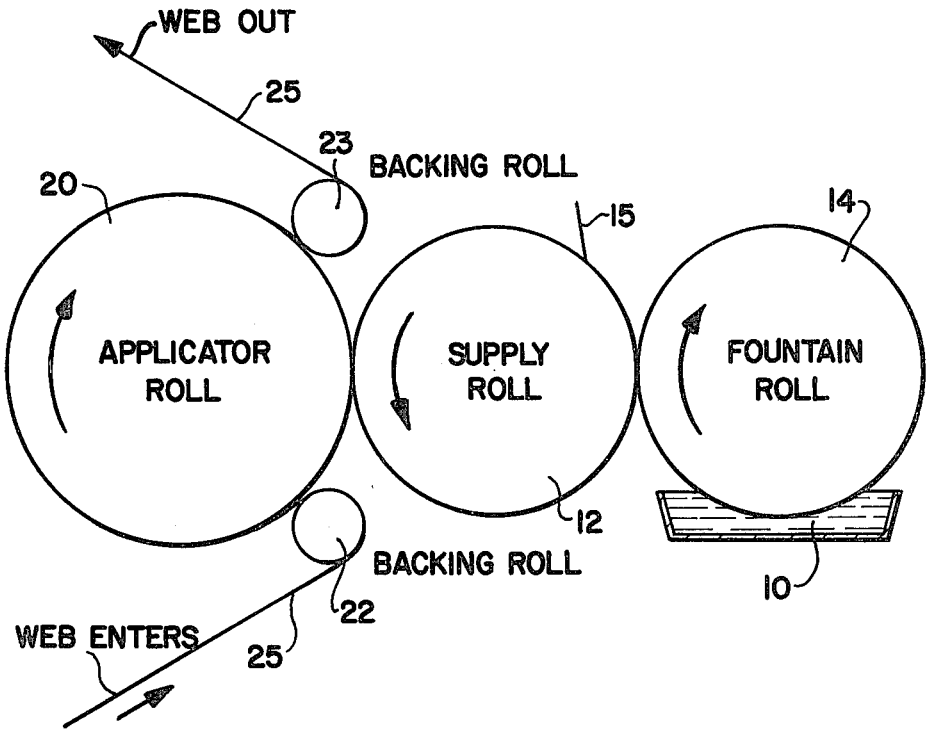
WEB OUT
25
23
BACKING ROLL
20
15
14
APPLICATOR ROLL
SUPPLY ROLL
FOUNTAIN ROLL
12
BACKING ROLL
10
22
WEB ENTERS
25

COATING METHOD APPARATUS FOR CAPSULAR COATINGS

BACKGROUND OF THE INVENTION

The present invention relates to the application of fluid compositions to endless webs, and more particularly to an apparatus and method for applying a fluid coating composition having solids suspended therein, such as a fluid composition containing rupturable microcapsules, to an endless web such as paper. The invention has particular utility in the production of so called carbon-less paper.

Examples of prior art machinery and methods in this field may be found in such references as U.S. Pat. No. 3,186,861, 3,384,536, 3,472,674, 3,630,835, 3,632,378, 3,767,451, 3,897,578, 3,914,511, 4,038,445, and 4,085,237. Reference may be had to these patents for a good general discussion of the difficulties associated with coating microcapsular compositions onto paper webs. Ideally, the least amount of material will be used and will be distributed evenly and uniformly along the surface of the paper. As a practical matter, however, the paper surface is not absolutely smooth. Therefore, mechanical devices for wiping off excess composition as it is being coated may leave too little on the "hills" and an excess in the "valleys". This can be avoided to some extent by using air knives or air jets for metering the coating composition as it is being applied. However, as pointed out, for example, in the '578 reference, air knives also have their disadvantages. The '445 reference discusses the disadvantages of both air knife metering and blade metering.

Another difficulty with applying coatings to paper arises because paper has "depth", in the sense that there are spaces among the various fibers of the paper web. If the micro capsular material penetrates into these spaces, it is no longer available at the web surface, so that excessive coat weights must be used to assure adequate availability of these microcapsular solids at the paper surface. In the '536 reference, penetration of the material is controlled by the chemical formation of a viscous solution of a film-forming polymer. In the '378, '451, and '237 references the web is calendared just prior to application of the material, to smooth and densify the web surface, thereby, helping to overcome some of these disadvantages.

Although a nip can be used, as in the '835 and '511 references, a nip (which is primarily for getting a bite into the paper to drive it) has the disadvantage that the microcapsules must be strong enough to withstand the nip pressures (as mentioned in the '551 reference). Also, the nip pressures tend to drive the microcapsular material into the interstices in the paper web. Air knife coaters require the use of a composition having a relatively low solids content. Thus, fairly large amounts of liquid carrier must be removed from the paper web, in addition to the disadvantages already mentioned.

The more well-known and established coating methods, therefore, all have disadvantages when used for high speed and high-solids content application of capsular formulated coatings. Air-knife coating is both speed and solids limited to levels well below the values otherwise attainable for capsular or formulated coatings. Blade application is primarily limited in the coat weight, requiring higher capsular coat weights than is necessary by other methods to obtain sufficient material uniformity on the surface for uniform surface functional response. Similarly, gravure offset gravure and reverse offset, gravure, all require either higher than necessary capsule coat weights and/or capsule size limitations to achieve the desired product performance. This is also true of reverse roll applications (as exemplified in the '861 and '674 references, both assigned to the assignee of the present invention).

A need therefore remains for a method and apparatus for applying a fluid coating composition having solids suspended therein to an endless web, and which will provide economical and efficient use of the solids while meeting the functional requirements of the coated product, such as uniformity and functional availability (at the surface).

Sheer and/or pressure forces developed during application should be avoided, and a more efficient usage of the solids in the coating composition should be achieved through improved orientation and distribution at the surface of the web material. Preferably, these results should be available for high speed application of coating compositions having a relatively high solids content.

SUMMARY OF THE INVENTION

Briefly, the present invention meets the above needs and purposes by pre-metering the coating composition onto an applicator roll and then wrapping the continuous web around the roll with a proper tension and for a sufficient time to allow the coating composition to be absorbed into the web on its own. Squeezing or compressing the web in a nip is avoided since the web is merely tensioned against the applicator roll. Thus, mechanical efforts to drive the coating into the sheet are avoided, so that the solids, e.g. microcapsules, are not driven into the base sheet material itself. Shear when coating to coat weight is avoided. Also, by contacting the coating composition onto the entire web surface, it is absorbed uniformly into the web, unaffected by the ordinary minute surface irregularities thereof. In addition, by allowing the composition to absorb into the web on a time scale, rather than relying on rapid passage through a relatively short nip, a greater proportion of the metered fluid composition is actually transferred to the base web. That is, as the web leaves the applicator roll, the remaining liquid coating composition is split. However, since the base web is allowed to absorb the coating on a time scale, the process actually gets deeper into the film split, so that most of the liquid composition remains with the web. Also, in a short nip transfer, the film split can break non-uniformly across the roll as the web exits, a disadvantage which the time based absorption of the present invention substantially avoids.

Proper metering of the fluid coating composition is provided, in the preferred embodiment, by a gravure roll onto which the composition is first applied and then doctored, to limit the amount of coating to the quantity which fills the cells of the gravure pattern. This is transferred by surface rolling contact to an e.g., 38-inch diameter) applicator roll, which is preferably covered on its surface with a relatively soft (75 P&I) rubber material. Very shortly after accepting the coating from the gravure cells, the applicator roll receives the paper web, which is wrapped about the applicator roll against the coating composition film thereon, and held in contact with the film for the maximum practical wrap of the applicator roll. Entry and exit backing rolls introduce the web to the applicator roll and guide it in close proximity thereto, and with a reasonably sharp wrap angle, for insuring maximum web stability and proper control of the film break during coating and release on the applicator roll. During this time the web is also kept in proper tension by known tensioning means, to keep the web in contact with the film on the applicator roll. The size of the applicator roll, the web speed (e.g., 1500 to 2000 fpm), and the amount of web wrap around the applicator roll will be adjusted, of course, according to the properties of the web and the fluid coating composition, in order to keep the web and film in contact for enough time to allow the web to extract the film.

It is therefore an object of the present invention to provide a method and apparatus for applying a fluid coating composition having solids suspended therein to an endless web; a method and apparatus which provide for applying such coatings at relatively high speeds and high solids content at minimum coating composition usage while providing the desired coated surface functional characteristics, such as uniformity of coating distribution and surface availability; in which the coating composition is metered onto the peripheral surface of a supply roll, then transferred to an applicator roll, and then to the endless web by passing the endless web in tensioned, substantially uncompressed contact with a predetermined portion of the surface of the applicator roll to uniformly and evenly transfer the metered coating composition to the web without shearing the composition when on the web or mechanically pressing the solids therein into the web; which is uncomplicated and inexpensive in its design and application; and which is readily suited for wide and economical use in the coating of many different such compositions on a great variety of coating machines and apparatus.

Other objects and advantages of the invention will be apparent from the following description, the accompanying drawings, and the appended claims.

BRIEF DESCRIPTION OF THE DRAWING

The drawing figure shows, in a simplified, cross-sectioned, schematic form, the various components utilized for practicing the present invention.

DESCRIPTION OF THE PREFERRED EMBODIMENT

With reference to the drawing, a supply of a fluid coating composition 10 having solids suspended therein is transferred and metered onto a rotatable gravure supply roll 12. This may be done, for example, by dipping a fountain roll 14 into the fluid supply 10 and then rolling roll 14 against the gravure surface on supply roll 12 to transfer a slight excess of the fluid composition to the supply roll. This assures that there will be at least enough of the coating composition thereon to fill the cells of the gravure pattern. A doctor blade 15 in contact with the gravure surface of supply roll 12 then removes the excess coating composition. In this manner, the gravure pattern itself meters the coating composition, and is selected to supply it at the desired rate.

The supply roll then carries the metered amount of the coating composition to a rotatable applicator roll 20 which is mounted in surface rolling contact with the supply roll 12 for receiving the metered coating composition therefrom. Next, an entry backing roll 22 and an exit backing roll 23 guide a continuous web 25, such as a web of paper, onto the surface of the applicator roll 20. Rolls 22 and 23 operate as a web wrapping means for passing the endless web 25 around and in tensioned, substantially uncompressed contact with a major portion (preferably more than half) of the surface of the applicator roll 20. In this manner, the entry and exit backing rolls 22 and 23 keep the web 25 in contact with the applicator roll 20 for a time sufficient to substantially absorb the metered fluid composition into the web, so that it is uniformly and evenly transferred thereto without shearing the composition when on the web or mechanically pressing the solids therein into the web.

The entry and exit backing rolls are mounted adjacent and on parallel axes with the applicator roll 20, slightly spaced therefrom (although the exit backing roll 23 may be mounted in contact with the applicator roll), with the web 25 preferably wrapped around more than half of each of the entry and exit rolls 22 and 23. This provides proper entry of the web onto the applicator roll for wrapping the web therearound, guiding it evenly onto and off the applicator roll, stabilizing the web thereon, the controlling the break or split of the fluid film upon release of the web from the applicator roll, to keep the split of the fluid film even.

As may be seen, therefore, the present invention has numerous advantages. Principally, it provides for high speed application of a relatively high solids capsular formulated coating composition to a paper web while affording economical and efficient usage of the capsules and fully satisfying the functional requirements of the final coated product. Shear when coating the web with the fluid composition is avoided. Similarly, squeezing or compressing in a nip is avoided. Instead, the web is tensioned against the surface of the applicator roll for a sufficient time to allow the metered fluid composition to absorb thereinto on a time scale. Thus, the suspended solids are uniformly distributed and deposited onto the web surface, and as the exit backing roll guides the web from the applicator roll, the process gets much deeper into the film split.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. A method for applying a fluid coating composition containing rupturable microcapsules, to an endless web, comprising:

(a) metering said coating composition onto the peripheral surface of a supply roll, (b) transferring said metered composition to an applicator roll, and (c) passing the endless web around and in tensioned, substantially uncompressed contact with more than half of the surface of the applicator roll, and keeping the web in contact with the applicator roll for a time sufficient to substantially absorb said metered composition into the web to uniformly and evenly transfer said metered coating composition to the web without shearing the composition when on the web or mechanically pressing the solids therein into the web.

2. The method of claim 1 further comprising wrapping the web around entry and exit rolls mounted adjacent and on parallel axes with the applicator roll for wrapping the web therearound and guiding the web evenly onto and off the applicator roll.

3. The method of claim 2 wherein at least the entry roll is spaced from the applicator roll, and further comprising wrapping the web around more than half of each of the entry and exit rolls to provide proper entry of the web to the applicator roll, stabilize the web thereon, and control the break or split of the fluid film upon release of the web therefrom, to keep it even.

4. The method of claim 1 wherein said metering step further comprises:

(a) using a supply roll having a gravure surface, (b) applying at least enough of the coating composition to the supply roll to fill the cells to the gravure pattern, and (c) removing excess coating composition from the gravure supply roll before it reaches the applicator roll.

5. A method for applying a fluid coating composition containing rupturable microcapsules, to an endless web, comprising:

(a) metering said coating composition onto the peripheral gravure surface of a supply roll by applying at least enough of the coating composition to the supply roll to fill the cells of the gravure pattern and removing excess coating composition from the gravure supply roll, (b) transferring said metered composition to an applicator roll, (c) passing the endless web around and in tensioned, substantially uncompressed contact with more than half of the surface of the applicator roll, and keeping the web in contact with the applicator roll for a time sufficient to substantially absorb said metered composition into the web, to uniformly and evenly transfer said metered coating composition to the web without shearing the composition when on the web or mechanically pressing the solids therein into the web, and (d) said passing step including wrapping the web around more than half each of an entry and an exit roll mounted adjacent and on parallel axes with the applicator roll for wrapping the web therearound and guiding the web evenly onto and off the applicator roll, with at least the entry roll being spaced from the applicator roll, to provide proper entry of the web to the applicator roll, stabilize the web thereon, and control the break or split of the fluid film upon release of the web therefrom, to keep it even.

* * * * *